US005399944A

United States Patent [19]

Konopka et al.

[11] Patent Number: 5,399,944

[45] Date of Patent: Mar. 21, 1995

[54] BALLAST CIRCUIT FOR DRIVING GAS DISCHARGE

[75] Inventors: John G. Konopka, Barrington; Peter W. Shackle, Arlington Heights, both of Ill.

[73] Assignee: Motorola Lighting, Inc., Buffalo Grove, Ill.

[21] Appl. No.: 146,268

[22] Filed: Oct. 29, 1993

[51] Int. Cl.[6] ..... H05B 37/02

[52] U.S. Cl. ..... 315/219; 315/247; 315/205; 315/307; 315/DIG. 5; 315/DIG. 7

[58] Field of Search ..... 315/219, 246, 247, 276, 315/254, 278, 307, 308, DIG. 5, DIG. 7, 205

[56] References Cited

U.S. PATENT DOCUMENTS 4,075,476 2/1978 Pitel ..... 315/DIG. 5 X 4,109,307 8/1978 Knoll ..... 315/205 X 4,277,728 7/1981 Stevens ..... 315/247 X

FOREIGN PATENT DOCUMENTS 0059053 9/1982 European Pat. Off. ..... 315/247

*Primary Examiner*—Robert J. Pascal

*Assistant Examiner*—Haissa Philogene

*Attorney, Agent, or Firm*—J. Ray Wood

[57] ABSTRACT

A circuit for powering gas discharge lamps includes a power factor correction inductor coupled to a source of rectified, pulsating AC power. An energy storage circuit is connected to the power factor correction inductor, and a switch is coupled to a junction between the power factor correction inductor and the energy storage circuit. A resonant circuit couples the energy storage circuit to the gas discharge lamps.

18 Claims, 4 Drawing Sheets

BALLAST CIRCUIT FOR DRIVING GAS DISCHARGE

FIELD OF THE INVENTION

This invention relates to circuits driving gas discharge lamps.

BACKGROUND OF THE INVENTION

An electronic ballast circuit for energizing gas discharge lamps is comprised of a rectifier for converting low frequency, alternating current ("AC") power to direct current ("DC") power; a boost for increasing the voltage of the DC power, and an inverter (commonly a half-bridge) to convert the DC power to AC power at a very high frequency (on the order of 24 kilohertz ("KHz")).

This type of circuit attains a high power factor and a low total harmonic distortion (THD), and is capable of being dimmed.

However, such a circuit requires three transistors and numerous other components. The topology is hard to manufacture as a low cost integrated circuit. The result is a ballast that is relatively expensive when compared with magnetic ballasts.

Attempts have been made to reduce the number of components. However, reduction of the number of components has heretofore either necessitated expensive high voltage integrated circuits ("ICs") or else has sacrificed power factor, THD and dimming capability.

A circuit which could be manufactured with few components using conventional low cost ICs and yet maintains a high power factor low THD and dimming capability is thus desireable.

BRIEF DESCRIPTION OF THE DRAWINGS

FIG. 2.2 is a transformer coupled unclamped energy storage circuit.

FIG. 2.3 is a direct coupled energy storage circuit where the clamped inductor has tightly coupled windings.

FIG. 2.4 is a transformer coupled energy storage circuit where the clamped inductor has tightly coupled windings.

FIG. 2.5 is a direct coupled energy storage circuit where the clamped inductor has loosely coupled windings.

FIG. 2.6 is a transformer coupled energy storage circuit where the clamped inductor has loosely coupled windings.

DESCRIPTION OF THE PREFERRED EMBODIMENT

To allow reduction of the number of components by conventional low cost integration, a power switching device should be controlled by signals which are close to circuit common in their potential level. (By contrast a conventional transistor half bridge has one of the transistors with its base or gate at high potential with respect to ground, which necessitates expensive level shifting circuitry) In this invention, a circuit: for powering gas discharge lamps includes a power factor correction inductor coupled to a source of rectified, pulsating AC power. An energy storage circuit is connected to the power factor correction inductor, and a switch is coupled to a junction between the power factor correction inductor and the energy storage circuit. A resonant circuit couples the energy storage circuit to the gas discharge lamps.

Such a circuit can provide a power factor of 0.996, with total harmonic distortion of 5.6%, third harmonic distortion of 2.7% and a lamp current crest factor of 1.27. The circuit utilizes a single transistor with its source or emitter grounded. Because level shifting is avoided, the circuit is economical and easy to manufacture using low cost integration techniques.

Figure 1:
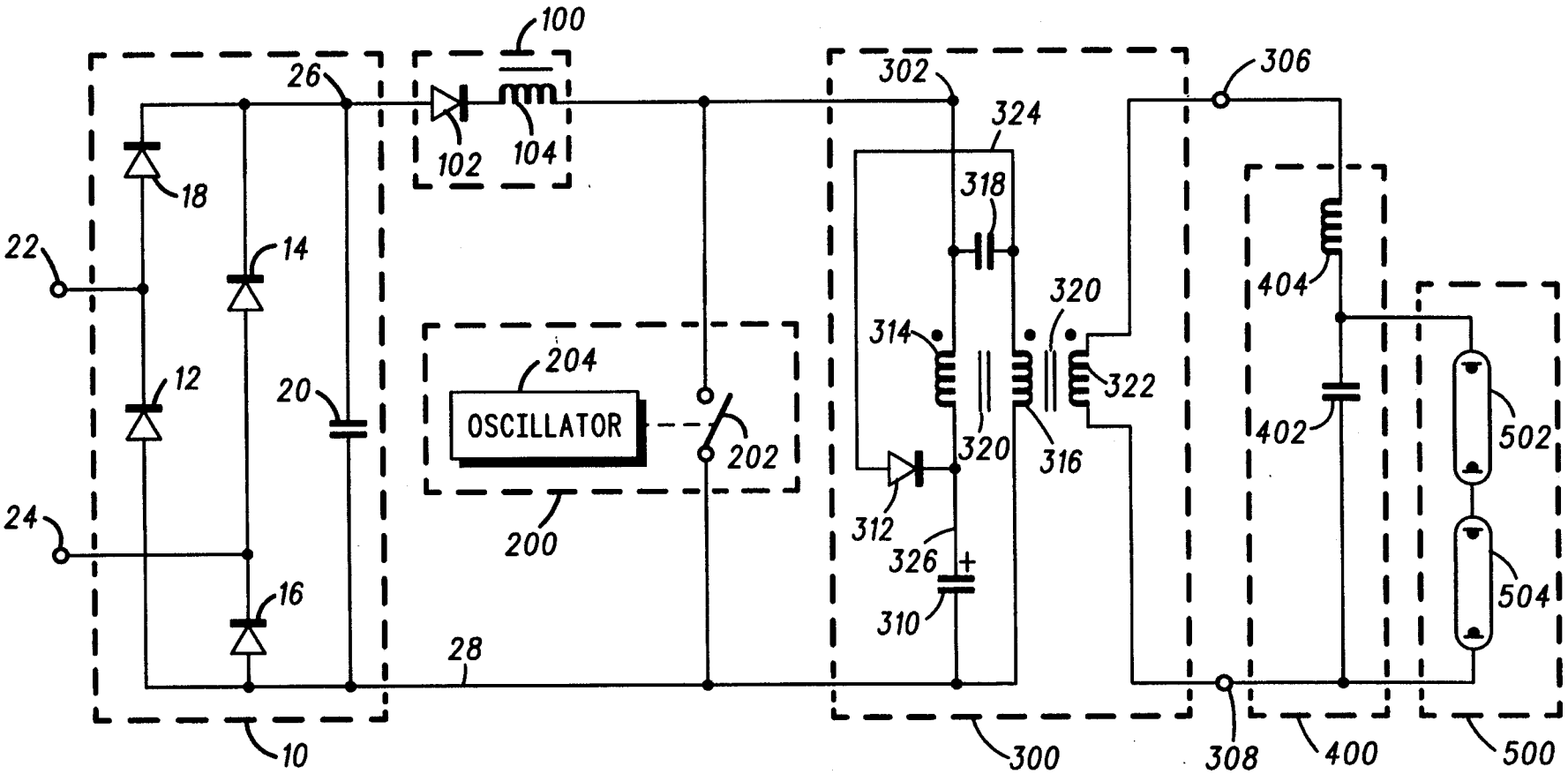
FIG. 1 is a schematic of a circuit for energizing gas discharge lamps.
Figure 2A:
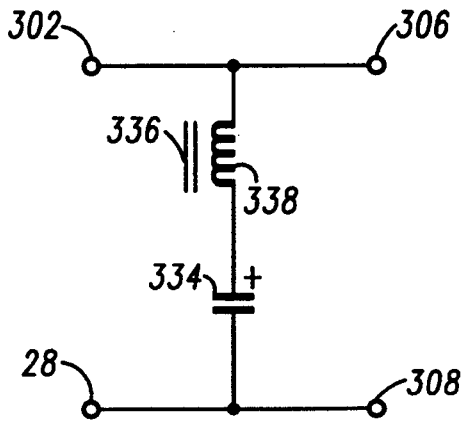
FIG. 2.1 is a direct coupled unclamped energy storage circuit.
Figure 2B:
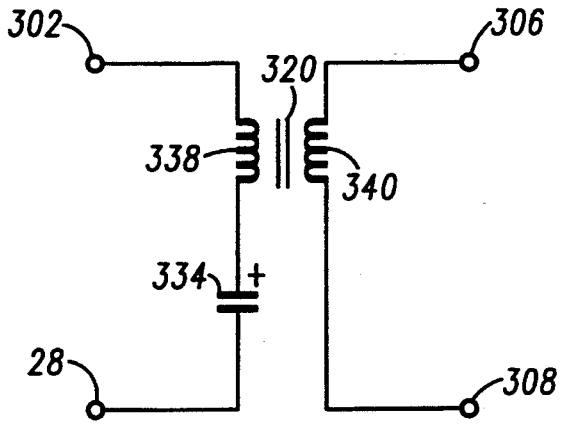
Figure 2C:
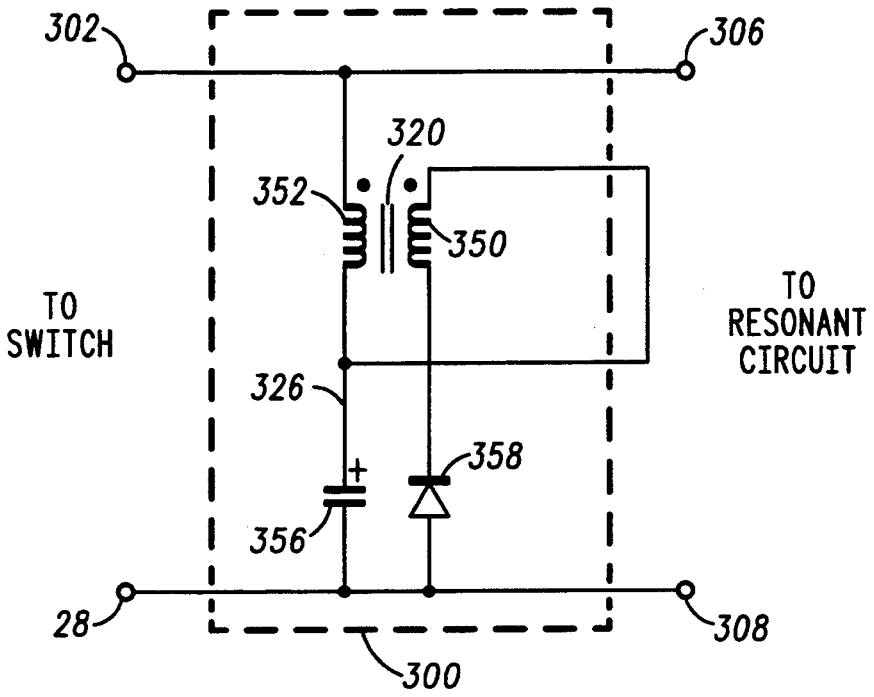
Figure 2D:
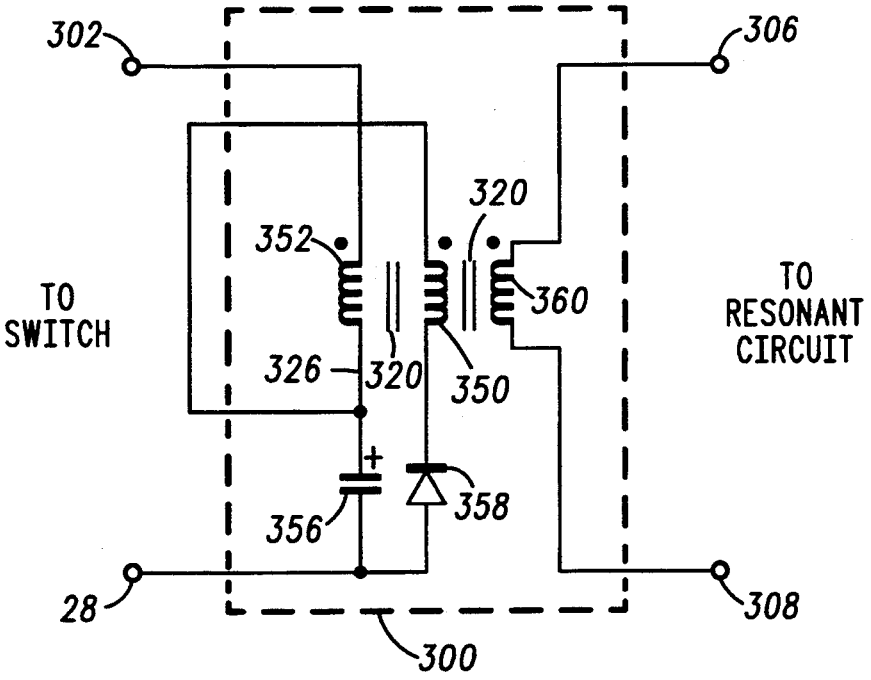
Figure 2E:
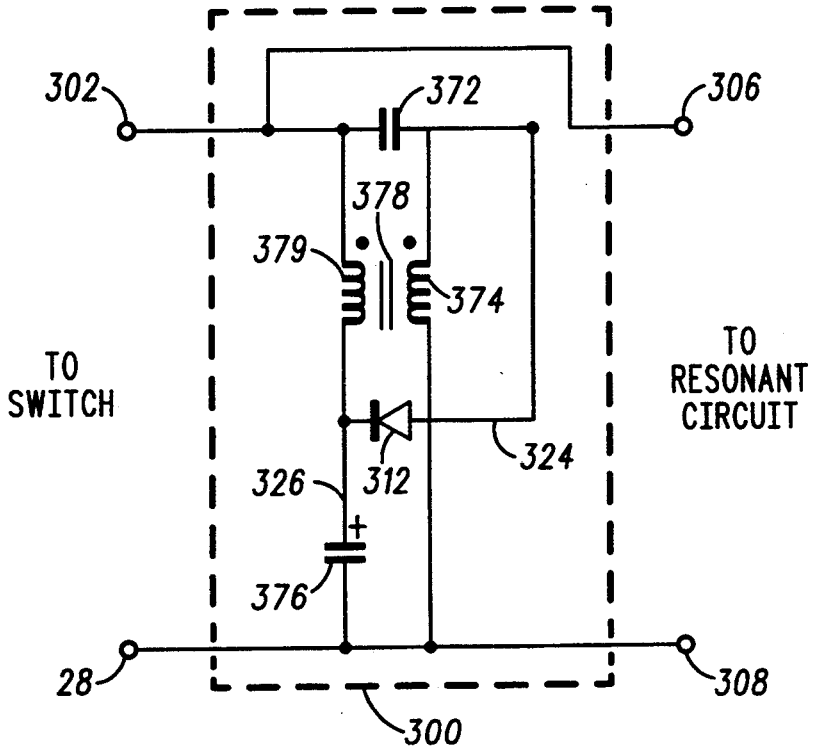
Figure 2F:
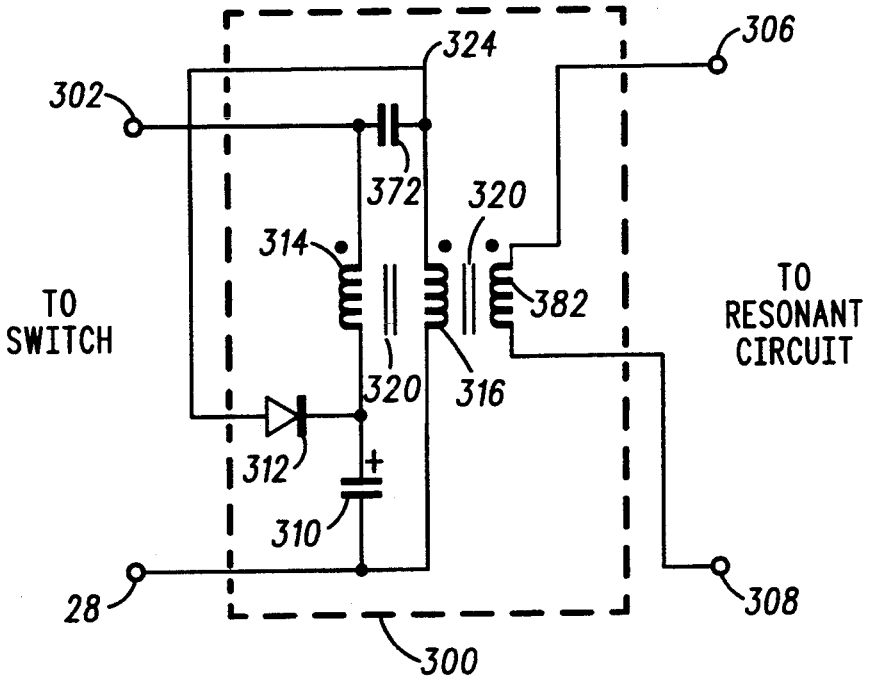

FIG. 1 shows a single transistor ballast circuit in accordance with the present invention. The principal parts of the circuit are a source of pulsating, full wave rectified AC power 10, a power factor correction circuit 100, a switch driven by an oscillator 200, an energy storage circuit 300, a resonant circuit 400 and a lamp circuit 500. Terminals 22 and 24 are connected to a source of low frequency AC power such as a 60 Hz, 120 V AC power line. Rectifier diodes 12, 14, 16, 18 convert the incoming sinusoidal waveform into a full wave, pulsating rectified AC voltage between common terminal 28 and positive terminal 26. Capacitor 20 prevents high frequency noise from the circuit operation escaping onto the power lines and acts as a low impedance source of current for the power factor correction circuit. A network of small inductors may be included to further reduce the noise to the desired level.

Switching circuit 200 comprises an oscillator 204 driving a switch 202. The oscillator 204 runs at a constant frequency, although some improvement in the ripple of the lamp current and the power factor property may be obtained by modulating the frequency in synchronization with the incoming power line.

The switch 202 has two switch terminals. One switch terminal is connected to common node 28. The other switch terminal is connected to node 302. Node 302 is the junction between power factor correction inductor 104 and energy storage circuit 300. Node 302 is thereby periodically connected to the common terminal 28 with a frequency determined by the oscillator 204. The switch may consist of any kind of high frequency device, such as for example a bipolar transistor, field effect transistor, thyristor, insulated gate bipolar transistor, or a vacuum tube device.

The switch 202 is connected to the full wave rectified AC power at node 26 through power factor correction inductor 104 and diode 102. Diode 102 is oriented so that power will not return to the source 10.

When the switch 202 is on, current builds up linearly with time through power factor correction inductor 104, charging it with current in proportion to the incoming voltage.

The energy stored by the power factor correction inductor 104 is proportional to the square of the current through it. Therefore this inductor, when periodically switched by switch 202, causes energy to be drawn from the source proportional to the square of the voltage, just as would result from the connexion of a resistor. The current drawn from the power line is thus in phase with and proportional to the voltage, resulting in a good power factor.

In the embodiment shown in FIG. 1, energy storage inductor 320 has a primary winding 314 and clamping winding 316. Primary winding 314 and clamping winding 316 have similar physical characteristics. Primary winding 314 has first and second primary winding terminals.

The first primary winding terminal of primary winding 314 is connected to switch 202. The second primary winding terminal of primary winding 314 is connected to the storage capacitor 310. The other side of the storage capacitor is connected to common terminal 28.

While switch 202 is turned on, current is drained from storage capacitor 310 through primary winding 314. This current builds up linearly in the same manner as the current through the power factor correction inductor 104. In this manner, energy is transferred from capacitor 310 to primary winding 314.

To understand the operation of the circuit, assume that storage capacitor 310 and auxiliary capacitor 318 are energized with the same voltage. When switch 202 turns on (i.e., is closed), terminal 302 is pulled to ground. Terminal 324 is pulled to a negative potential which is the same voltage below common as terminal 326 is above it. Current builds up in clamping winding 316 which is the same magnitude as the .current building up in primary winding 314. Since node 324 is more negative than node 326, diode 312 is reverse biased and non conducting while switch 202 is on.

At the end of the on period of switch 202, switch 202 turns off. (For this purpose a high switching speed is desirable to achieve good efficiency. Methods of controlling and enhancing the switching speed of solid state switches are documented in the literature of power electronics.) With switch 202 off, the voltage on node 302 rises as the currents through power factor correction inductor 104, primary winding 314 and clamping winding 316 continue. When the voltage is sufficient that diode 312 forward biases, the voltage at node 302 is clamped at a potential (above common terminal 28) equal to the sum of the voltages across capacitor 310, capacitor 318 and forward biased diode 312. The currents through power factor correction inductor 104, primary winding 314 and secondary winding 316 diminish with time until they reach zero, at which point all the energy from the currents in power factor correction inductor 104, primary winding 314 and secondary winding 316 has been transferred to capacitors 310 and 318. Since charge has been pulled from the power line, the voltage on the capacitors 318 and 310 will continue to increase as switch 202 cycles on and off, unless energy is removed from the system by the action of the resonant circuit and the lamps.

Since primary winding 314 is across capacitor 310 and secondary winding 316 is across capacitor 318, then transformer action forces these two capacitors to have the same voltage across them.

The voltage at node 302 consists of a square wave which is alternately zero when switch 202 is on and twice the voltage across capacitor 310 when switch 202 is off. The voltage across output winding 322 is therefore also a square wave.

Nodes 306, 308 are the output terminals of the energy storage circuit. Resonant circuit. 400, consisting of a series inductor 404 and capacitor 402 is placed across output winding 322 to couple energy from the system. The resonant circuit 400 is inductively coupled with the energy storage circuit via output winding 322.

Inductor 404 and capacitor 402 resonate at a frequency slightly lower than that at which switch 202 is switched. Discharge lamps 502, 504 are placed across the capacitor 402 so that an AC current flows through third winding 322, inductor 404 and through the lamps 502, 504.

The higher the voltage rises on capacitor 310, the more current flows through the lamps, drawing additional power from capacitor 310 until equilibrium is reached. The power level of the circuit: is adjusted by changing the inductance of inductor 104. A smaller inductance for inductor 104 results in more power, and vice versa.

In the operation of the circuit, the voltage at node 302 is clamped by the energy storage circuit 300 so that at times when the incoming line voltage is highest, energy is stored in the storage capacitor 310. At times when the power line voltage is low or zero, energy is drawn from the energy storage capacitor 310 and converted into current in windings 314 and 316. Since the storage capacitor 310 runs with a voltage just below the peak of the line, the voltage which is presented to the power factor correction inductor at node 302 is approximately twice the peak of the line. When oscillator 204 is running with 50% duty cycle, this results in a near unity power factor for the impedance which the system presents to the AC power line.

The operation of the circuit described above has various advantages which are apparent upon consideration of its operation. Energy is stored in the capacitor 310, which normally operates with a voltage just slightly less than the peak of the line. This is advantageous compared to many other ballast circuits which require energy storage capacitors to operate at voltages well above the peak of the line. Only one power transistor is used for the entire operation of the circuit, compared to two or three transistors which are used in comparable power factor corrected ballasts. By running the oscillator 204 at less than 50% duty cycle, the light output may be dimmed while still maintaining good power factor.

In FIG. 1, the energy storage circuit 300 stores energy either as electrostatic energy in capacitor 310 or as magnetic energy in energy storage inductor 320 when current is flowing through windings 314, 316. In operation energy is constantly interchanged between these two forms.

Although one particular form of energy storage circuit is shown in FIG. 1, several different forms are possible. If in the application the lamps do not need the isolation from the circuit common terminal provided by output winding 322, direct coupling may be satisfactory.

If the lamps are permanently attached, clamping may not be necessary. In this case, the energy storage circuit 300 has the very simple form shown in FIG. 2.1, consisting of only an energy storage capacitor 334 and the inductor 336 with winding 338. Without clamping the energy delivered to the lamp will fluctuate considerably, but the circuit will still run off the energy stored in capacitor 334 at line zero crossing. Direct coupling has the advantage that some current can flow directly from the power factor correction circuit 100 and into the resonant circuit 400 without going through any energy storage circuit at ,all. This results in great efficiency. An autotransformer winding can be added to winding 338 to provide increased output voltage if desired. With direct coupling a DC blocking capacitor has to be added in series with the lamps to prevent direct current from flowing through the lamps.

To isolate the lamps from the input, or to adjust the output voltage, an output winding 340 can be added to the circuit of FIG. 2.1 as shown in FIG. 2.2.

When it is desired to reduce the ripple in the lamp current and to clamp the switch voltage in the case where the lamps are removed, a clamping winding is needed. One way to do this is as shown in FIG. 2.3. Clamping winding 350 has the same number of turns as primary winding 352. Primary winding 352 and clamping winding 354 are closely coupled, usually using bifilar winding techniques. When the voltage across windings 350, 352 becomes equal to the voltage across storage capacitor 356, clamping diode 358 becomes forward biased. Charge is transferred through clamping diode 358 and clamping winding 350 into storage capacitor 356. The clamping winding 350 is series connected to clamping diode 358, and the combination is in parallel with storage capacitor 356.

Thus, the presence of the clamping winding 350 constrains the voltage across winding 352 from exceeding the voltage across storage capacitor 356. If isolation is needed, an output winding 360 can be added as shown in FIG. 2.4.

The circuits shown in FIGS. 2.3 and 2.4 require care to manufacture with high reliability because the wires of windings 314 and 316 have to be extremely close together to get good magnetic coupling, and yet far apart to get good voltage isolation. If they are not close enough together, the voltage on node 302 is not clamped satisfactorily resulting in high voltage spikes being applied to the switch 202. Voltage spikes require either a more expensive higher voltage switch, or an expensive snubber circuit.

Alternatively, windings on the inductor in the energy storage circuit may be loosely coupled together, if the clamping circuit shown in FIG. 2.5 is used.

Primary winding 370 has first and second primary winding terminals. The first primary winding terminal is connected to storage capacitor 376 and the second primary winding terminal is connected to switch 202 at node 302. The clamping winding 374 has first and second clamping winding terminals. The first clamping winding terminal is coupled to circuit common 28, while the second clamping winding terminal is connected through diode 312 to the first primary winding terminal. Auxiliary capacitor 372 is connected between the second clamping winding terminal and switch 202 at node 302. Resonant circuit 400 is in parallel with switch 202.

In this circuit the voltage across primary winding 370 is clamped across capacitor 372, and the voltage across clamping winding 374 is clamped across storage capacitor 376. Thus, if there is any leakage inductance present between the two windings 370, 374, the energy is "recycled" into capacitors 372 and 376. This configuration is especially desirable when directly coupled to the lamps, since the energy storage inductor 100 drives the lamps directly, with a large fraction of the energy never being processed by the energy storage circuit 300.

For this reason transformer 378 can be relatively small and inexpensive. However, where isolation of the lamps for the power line is essential, an output winding 382 can be added as shown in FIG. 2.6. Output winding 382 is connected to resonant circuit 400. This feature results in a slightly larger core being used for transformer 320 compared to transformer 378.

In the preferred embodiment of this invention, the lamps were transformer coupled as shown in FIG. 1. Capacitor 20 had a value of 0.22 mF (microFarads), inductor 104 was 1 mH (milliHenrys), windings 314 and 316 had inductance of 3.25 mH each, capacitor 310 was 47 mF/250 V, inductor 404 was 3.35 mH, capacitor 402 was 6.8 nF (nanoFarads). The operating frequency was 33 KHz, running off a 120 V 60 Hz power line. The power factor was 0.996, with total harmonic distortion of 5.6% . The lamp current crest factor was 1.27. The peak voltage on the switch was 320 V. Two 4 ft T8 lamps were driven at a current level of 177 milliamps with a input power level of 60 watts.

Numerous detailed precautions are customarily incorporated in electronic ballast circuits. For example, provision may be made to drive the heaters customarily used on many fluorescent lamps by utilizing auxiliary windings on any of the inductors 104, 320, 404. Small capacitors are often placed in association with the lamps 502, 504 to facilitate starting. Two lamps are shown here, but the same principles may be applied to driving various numbers of lamps. Resonant inductor 404 is shown here as one single inductor, although it may often be desirable for it to be in more than one part, similarly with capacitor 402. The lamps are shown here driven in series, but other configurations such as in parallel with more than one resonant inductor winding are possible. Inductive EMI (electromagnetic interference) suppression circuits may be applied to the front end of the ballast to improve EMI performance. In addition various kinds of EMI suppression circuits may be applied to the switch 202 to improve its EMI performance.

Certain alterations and modifications of the present invention will no doubt become apparent to those skilled in the art. The following claims should be interpreted to cover all such alterations and modifications as fall within the true spirit and scope of the invention.

We claim:

1. A ballast circuit for driving a gas discharge lamp comprising:

a source of pulsating, rectified AC;

a power factor correction inductor coupled to the source;

an energy storage circuit comprising an energy storage inductor with its first terminal connected to the switch and its second to a storage capacitor, the energy storage circuit connected to the power factor correction inductor;

a switch, coupled to a junction between the power factor correction inductor and the energy storage circuit;

a resonant circuit coupled to the energy storage circuit for energizing the gas discharge lamp; and the energy storage inductor having a primary winding and an output winding, the primary winding having first end second primary winding terminals, the first terminal being a connected to the switch and the second terminal connected to a storage capacitor connected to circuit common; the output winding connected to the resonant circuit.

2. The circuit of claim 1 including a diode coupled in series with the power factor correction inductor and oriented to stop power from returning to the source from the energy storage circuit.

3. The circuit of claim 2 where the resonant circuit is inductively coupled to the energy storage circuit.

4. The circuit of claim 2 where the resonant circuit is connected to the energy storage circuit.

5. The circuit of claim 1 where the energy storage inductor has a primary winding and a clamping winding, and where the primary winding has first and second primary winding terminals, where the first primary winding terminal is connected to a storage capacitor and the second primary winding terminal is connected to the switch.

6. The circuit of claim 5 where the storage capacitor is connected between the first primary winding terminal and a circuit common.

7. The circuit of claim 6 where the clamping winding is series connected to a clamping diode, and the series combination of the diode and the clamping winding is connected in parallel with the storage capacitor.

8. The circuit of claim 7 where the resonant circuit is connected in parallel with the switch.

9. The circuit of claim 7 where the energy storage inductor has an output winding, and the resonant circuit is connected to the output winding.

10. The circuit of claim 1 where the energy storage inductor comprises a transformer with two loosely coupled windings.

11. The circuit of claim 10 where one of the two windings is a primary winding and the other winding is a clamping winding, and where the primary winding has first and second primary winding terminals, where the first primary winding terminal is connected to a storage capacitor and the second primary winding terminal is connected to the switch.

12. The circuit of claim 11 where the clamping winding has first and second clamping winding terminals, the first clamping winding terminal coupled to a circuit common, and the second clamping winding terminal connected through a clamping diode to the first primary winding terminal.

13. The circuit of claim 12 where an auxiliary capacitor is connected between the second clamping winding terminal and the switch.

14. The circuit of claim 13 where the resonant circuit is connected in parallel with the switch.

15. The circuit of claim 12 where the energy storage inductor has an output winding, and the resonant circuit is connected to the output winding.

16. A ballast circuit for driving a gas discharge lamp comprising:

a source of pulsating, rectified AC;

a power factor correction inductor coupled to the source;

a diode coupled in series with the power factor correction inductor and oriented to stop power from returning to the source from the energy storage circuit;

an energy storage inductor connected to the power factor correction inductor at a junction, the energy storage inductor having at least one clamping winding;

a switch coupled between a circuit common and the junction between the power factor correction inductor and the energy storage inductor;

a storage capacitor coupled between the energy storage inductor and the circuit common;

a resonant circuit inductively coupled to the energy storage circuit for energizing the gas discharge lamp; and the energy storage inductor having a primary winding and an output winding, and the resonant circuit coupled to the energy storage inductor by way of the output winding.

17. The circuit of claim 16 where the windings of the energy storage inductor are tightly coupled.

18. The circuit of claim 16 where the windings of the energy storage inductor are loosely coupled.

* * * * *